US012203220B2

(12) United States Patent
Castro et al.

(10) Patent No.: US 12,203,220 B2
(45) Date of Patent: Jan. 21, 2025

(54) FORMULATION FOR SIZE PRESS APPLICATIONS

(71) Applicant: ECOLAB USA INC., St. Paul, MN (US)

(72) Inventors: David J. Castro, DeKalb, IL (US); Victor Fuk-Pong Man, St. Paul, MN (US); Stephen Raye Marrou, Mount Prospect, IL (US); Gang Pu, Shoreview, MN (US)

(73) Assignee: Ecolab USA Inc., St. Paul, MN (US)

( * ) Notice: Subject to any disclaimer, the term of this patent is extended or adjusted under 35 U.S.C. 154(b) by 408 days.

(21) Appl. No.: 17/607,145

(22) PCT Filed: Mar. 31, 2020

(86) PCT No.: PCT/US2020/025918
§ 371 (c)(1),
(2) Date: Oct. 28, 2021

(87) PCT Pub. No.: WO2020/236312
PCT Pub. Date: Nov. 26, 2020

(65) Prior Publication Data

US 2022/0205185 A1 Jun. 30, 2022

Related U.S. Application Data

(60) Provisional application No. 62/850,267, filed on May 20, 2019.

(51) Int. Cl.

| | |
|---|---|
| ***D21H 23/56*** | (2006.01) |
| ***D21H 19/32*** | (2006.01) |
| ***D21H 19/54*** | (2006.01) |
| ***D21H 21/16*** | (2006.01) |
| ***D21H 21/20*** | (2006.01) |
| ***D21H 21/24*** | (2006.01) |

(52) U.S. Cl.
CPC ..... *D21H 23/56* (2013.01); *D21H 19/32* (2013.01); *D21H 19/54* (2013.01); *D21H 21/16* (2013.01); *D21H 21/20* (2013.01); *D21H 21/24* (2013.01)

(58) Field of Classification Search
CPC ..... D21H 23/56; D21H 19/32; D21H 19/54; D21H 21/16; D21H 21/20; D21H 21/24; D21H 21/18
See application file for complete search history.

(56) References Cited

U.S. PATENT DOCUMENTS

| | | | | |
|---|---|---|---|---|
| 4,959,125 | A | 9/1990 | Spendel | |
| 6,841,039 | B1 | 1/2005 | Lokietek et al. | |
| 8,696,869 | B2 * | 4/2014 | Borkar | C09D 133/26 162/168.3 |
| 9,789,722 | B2 * | 10/2017 | Nagoshi | B41M 5/41 |
| 11,059,992 | B2 * | 7/2021 | Zha | C03C 17/005 |
| 2002/0096275 | A1 | 7/2002 | Lindgren et al. | |
| 2004/0001963 | A1 | 1/2004 | Watanabe et al. | |
| 2004/0118531 | A1 | 6/2004 | Shannon et al. | |
| 2004/0118532 | A1 | 6/2004 | Sarbo et al. | |
| 2006/0014640 | A1 | 1/2006 | Tani et al. | |
| 2007/0020462 | A1 | 1/2007 | Rudolph et al. | |
| 2008/0098931 | A1 | 5/2008 | Skaggs et al. | |
| 2008/0173420 | A1 | 7/2008 | Song et al. | |
| 2008/0277084 | A1 * | 11/2008 | Denowski | D21H 17/16 524/598 |
| 2009/0017235 | A1 * | 1/2009 | Bays | D21H 17/11 428/32.18 |
| 2011/0112224 | A1 * | 5/2011 | Borkar | C09J 133/06 524/47 |
| 2012/0121873 | A1 | 5/2012 | Mann et al. | |
| 2014/0259458 | A1 | 9/2014 | Duggirala et al. | |
| 2015/0020985 | A1 * | 1/2015 | Reed | D21H 23/30 427/209 |
| 2018/0195237 | A1 | 7/2018 | Toles et al. | |
| 2018/0251945 | A1 | 9/2018 | Lepo et al. | |
| 2022/0205185 | A1 * | 6/2022 | Castro | D21H 19/32 |

FOREIGN PATENT DOCUMENTS

| | | | | | |
|---|---|---|---|---|---|
| CN | 101688370 | A | | 3/2010 | |
| CN | 106835834 | A | | 6/2017 | |
| CN | 109072565 | A | | 12/2018 | |
| CN | 113874582 | B | * | 2/2024 | D21H 19/32 |
| EP | 0347176 | B2 | | 7/1997 | |
| EP | 2740841 | A1 | * | 6/2014 | B01D 19/04 |
| EP | 3034693 | B1 | | 8/2018 | |
| EP | 3423632 | B1 | * | 5/2020 | D21H 17/00 |
| WO | 2002081587 | A1 | | 10/2002 | |
| WO | 2008141093 | A1 | | 11/2008 | |
| WO | 2017151084 | A1 | | 9/2017 | |
| WO | WO-2020236312 | A1 | * | 11/2020 | D21H 19/32 |

OTHER PUBLICATIONS

Li, Jian-Wen et al., Preparation and Properties of Cationic Surface Sizing Agent with High Solid Content and Low Foam, Chung-kuo Tsao Chih / China Pulp and Paper, Nov. 2006, 25(11), pp. 27-31; Language: Chinese. English abstract found on last page of article (p. 31).

PCT International Preliminary Report on Patentability for PCT/US2020/025918, mailed Dec. 2, 2021, 11 pages.

* cited by examiner

*Primary Examiner* — Jose A Fortuna
(74) *Attorney, Agent, or Firm* — Eric D. Babych; Barnes & Thornburg LLP

(57) ABSTRACT

Paper treating compositions and methods of using the same are disclosed herein. The paper treating compositions of the present disclosure may include a strength agent and a surfactant or a sizing agent and a surfactant. The compositions and methods can be used to improve sizing and paper strength, especially, for example in spray size press applications.

7 Claims, No Drawings

FORMULATION FOR SIZE PRESS APPLICATIONS

BACKGROUND

1. Field of the Invention

The present disclosure generally relates to formulations for the treatment of substrates. More particularly, the disclosure relates to size press formulations and methods of treating paper using the size press formulations.

2. Description of the Related Art

A spray size press attempts to minimize the wear and tear traditionally associated with metered size presses by bypassing the 'metering' of a film on the press roll. Instead, the spray size press requires the formulation to be sprayed onto the coating roll a very short time before it is pressed against the paper.

In the papermaking industry, "sizing" is the treatment of paper which gives it resistance to the penetration of liquids (particularly water) or vapors. Sizing agents can be applied internally through the wet end or on the surface as part of a size press formulation.

In general, the strength of paper products is a property having three categories, referred to as dry strength, wet strength or rewetted strength, and wet web strength. Dry strength is the strength exhibited by the dry paper sheet, typically conditioned under constant humidity and room temperature prior to testing. Wet strength, or rewetted strength, is the strength exhibited by a paper sheet that has been fully dried and then rewetted with water prior to testing. Wet web strength is strength of a cellulosic fiber mat prior to drying to a paper product. Strength agents are compositions of matter effective at increasing one or more of these strength properties.

There is a need for formulations that have desirable properties for use in size press applications. For example, formulations that improve sizing and/or strength characteristics of the treated paper.

BRIEF SUMMARY

A method of treating paper is provided. The method may include applying a composition onto a paper press roll to form a coated paper press roll, the composition comprising a strength agent, a sizing agent, and a surfactant; and contacting paper with the coated paper press roll to form a treated paper. The treated paper may have a Cobb value equal to or less than a Cobb value of paper treated with the strength agent and the sizing agent but not with the surfactant.

In some aspects, the composition may be sprayed onto the paper press roll.

In some aspects, the surfactant comprises formula I:

I

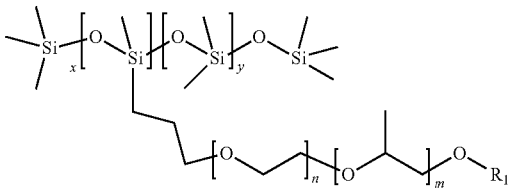

wherein n may be an integer ranging from 0 to 100; m may be an integer ranging from 0 to 100; x may be an integer ranging from 1 to 3; y may be an integer ranging from 0 to 5; and $R_1$ may be hydrogen, halogen, $C_{1-10}$ alkyl, phenyl, or cycloalkyl.

In some aspects, the surfactant may be selected from the group consisting of a polyether polysiloxane, an alkoxylated ethylenediamine, and any combination thereof.

In some aspects, the surfactant may be

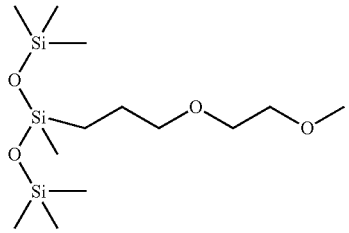

In some aspects, the treated paper may have a Cobb value at least about 10 percent less than the Cobb value of a paper treated with the strength agent and the sizing agent but not with the surfactant.

A method of treating paper is also provided. The method may include applying a composition onto a paper press roll to form a coated paper press roll, the composition comprising a strength agent and a surfactant; and contacting paper with the coated paper press roll to form a treated paper. The treated paper may have a tensile strength value greater than a tensile strength value of paper treated with the strength agent but not with the surfactant.

A paper coating composition is provided. The composition may include a strength agent; and a surfactant. A surface tension of the composition may be at least about 5 percent less than a composition comprising the strength agent but not the surfactant.

In some aspects, the surfactant may be non-ionic.

In some aspects, the surfactant comprises formula II:

II

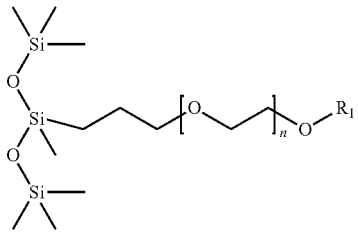

wherein n may be an integer ranging from 0 to 100; and $R_1$ is hydrogen, halogen, $C_{1-10}$ alkyl, phenyl, or cycloalkyl.

In some aspects, the surfactant comprises formula III

III

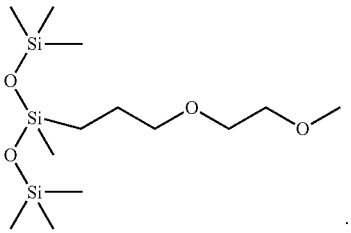

In some aspects, the surfactant may be ethylenediamine tetrakis(ethoxylate-block-propoxylate) tetrol.

In some aspects, the alkoxylated ethylenediamine may have a molecular weight of about 3,000 Da to about 5,000 Da.

In some aspects, the strength agent may be selected from the group consisting of an anionic starch, non-ionic starch, amphoteric starch, and any combination thereof.

In some aspects, the composition may include a colorant.

In some aspects, the composition may include about 2 wt % to about 10 wt % of the strength agent and about 0.005 wt % to about 0.5 wt % of the surfactant.

A paper coating composition is provided. The composition may include a sizing agent; and a surfactant. The composition may have a contact angle on a the surface of the size press roll of at least about 15 percent less than a composition comprising the sizing agent but not the surfactant, or a surface tension of the composition may be at least about 5 percent less than a composition comprising the sizing agent but not the surfactant.

A paper press roll comprising the any of the compositions described herein is provided.

A use of any of the compositions described herein for sizing paper is provided.

A method of treating paper is also provided. The method may include applying any of the compositions described herein onto a paper press roll to form a coated paper press roll; and contacting paper with the coated paper press roll.

A paper coating composition is provided that may include a strength agent; a sizing agent; and a surfactant. The surface tension of the composition may be at least about 5 percent less than a composition comprising the strength agent and the sizing agent but not the surfactant.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

DETAILED DESCRIPTION

Various embodiments of the present disclosure are described below. The relationship and functioning of the various elements of the embodiments may better be understood by reference to the following detailed description. However, embodiments are not limited to those explicitly described below.

A paper coating composition is provided. The composition may include a strength agent and a surfactant. In some aspects, the composition may optionally include a sizing agent, a colorant, or other component.

In some aspects, the paper coating composition may consist of a strength agent, a surfactant, and water. The composition may exclude a sizing agent, a colorant, or other component. In some aspects, the paper coating composition may consist essentially of a strength agent, a surfactant, and water, thereby excluding any additional component that may affect the basic and novel properties of the composition. For example, a basic and novel property of the compositions disclosed herein is the reduction in surface tension when a surfactant is present compared to a composition without a surfactant.

In some aspects, a paper coating composition is provided that may include a sizing agent and a surfactant. In some aspects, the composition may optionally include a strength agent, a colorant, or other component.

In some aspects, the paper coating composition may consist of a sizing agent, a surfactant, and water. The composition may exclude a strength agent, a colorant, or other component. In some aspects, the paper coating composition may consist essentially of a sizing agent, a surfactant, and water, thereby excluding any additional component that may affect the basic and novel properties of the composition.

A paper coating composition is provided that may include a strength agent, a sizing agent, and a surfactant. In some aspects, the composition may optionally include a colorant or other component.

In some aspects, the amount of surfactant on the paper is less than about 0.03 percent by weight.

In some aspects, the paper coating composition may consist of a strength agent, a sizing agent, a surfactant, and water. The composition may exclude a colorant or other component. In some aspects, the paper coating composition may consist essentially of strength agent, a sizing agent, a surfactant, and water, thereby excluding any additional component that may affect the basic and novel properties of the composition.

A paper coating composition is provided that may include a strength agent, a sizing agent, a colorant, and a surfactant. In some aspects, the composition may optionally include other components.

In some aspects, the paper coating composition may consist of a strength agent, a sizing agent, a colorant, a surfactant, and water. The composition may exclude other components. In some aspects, the paper coating composition may consist essentially of strength agent, a sizing agent, a surfactant, a colorant, and water, thereby excluding any additional component that may affect the basic and novel properties of the composition.

In some aspects, the compositions disclosed herein may be an aqueous solution. In some aspect, the composition may or may not be an emulsion or a dispersion.

In some aspects, the compositions disclosed herein may be sprayable. A sprayable composition is advantageous for use in a spray size press where the formulation is sprayed onto the coating roll a very short time before the coating roll is pressed against the paper.

The pH of the paper coating compositions is not particularly limited to any specific pH or pH range. In some aspects, the pH of the composition may be from about 3 to about 8.

The surface tension of the composition may be at least about 5 percent less than a composition comprising the strength agent but not the surfactant. In some aspects, the surface tension of the composition may be at least about 5 percent less than a composition comprising the sizing agent but not the surfactant. In some aspects, the surface tension of the composition may be at least about 5 percent less than a composition comprising the strength agent and the sizing agent but not the surfactant.

In some aspects, the surface tension of the composition may be about 5 percent to about 90 percent less than a composition having the same components except for the surfactant. In some aspects, the surface tension of the composition may be about 5 percent to about 90 percent less, about 10 percent to 90 percent less, about 20 percent to 90 percent less, about 10 percent to about 80 percent less, about 10 percent to about 70 percent less, or about 20 percent to about 70 percent less than a composition having the same components except for the surfactant. In some aspects, the surface tension of the composition may decrease by about 10 percent, about 20 percent, about 30 percent, about 40 percent, about 50 percent, about 60 percent, or about 70 percent when a surfactant is added to the composition.

The surface tension may be determined using known techniques in the art. For example, the surface tension may be determined using a Wilhelmy plate technique and may be reported in units of milliNewton per meter (mN/m).

Other properties for determining the impact of the surfactant on the composition may be contact angle. The contact angle of a liquid drop against a surface is defined as the angle formed by two lines: the solid surface and a tangent to the liquid drop that intersects the point where the liquid, solid and air interfaces meet. The lower the contact angle is, the higher the affinity of the droplet for the surface and the greater the wettability. The composition may have a contact angle on a roll surface of at least about 15 percent less than a composition without the surfactant. In some aspects, the composition may have a contact angle on a roll surface of about 15 percent to about 60 percent less, about 20 percent to about 60 percent less, or about 20 percent to about 50 percent less than a composition without the surfactant. The contact angle may be measured using methods known to one of ordinary skill in the art such as, for example, image analysis techniques.

The compositions disclosed herein may include a surfactant. As used herein "surfactant" includes anionic, nonionic, cationic, amphoteric, and zwitterionic surfactants.

In some aspects, the surfactant may be non-ionic.

In some aspects, the surfactant may be a polyether polysiloxane. For example, a polyether polysiloxane may have the chemical structure of formula I.

I

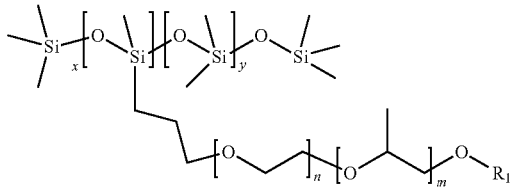

where n may be an integer ranging from 0 to 100; m may be an integer ranging from 0 to 100; x may be an integer ranging from 1 to 3; y may be an integer ranging from 0 to 5; and $R_1$ may be hydrogen, halogen, $C_{1-10}$ alkyl, phenyl, or cycloalkyl.

In some aspects, n may be an integer ranging from 1 to 50, 1 to 20, or 1 to 10; m may be an integer ranging from 0 to 50, 0 to 20, or 0 to 10; x may be 1; y may be 0; and $R_1$ may be hydrogen, halogen, or $C_{1-10}$ alkyl.

In some aspects, n may be 1 to 50, 1 to 20, or 1 to 10. In some aspects, n may be 1. In some aspects, m may be 0 to 50, 0 to 20, or 0 to 10. In some aspects, m may be 0.

In some aspects, x may be 1 and y may be 0.

In some aspects, $R_1$ may be hydrogen, halogen, or $C_{1-10}$ alkyl. In some aspects, $R_1$ may be methyl.

The term "alkyl," as used herein, refers to a linear or branched hydrocarbon radical, preferably having 1 to 10 carbon atoms (i.e., 1, 2, 3, 4, 5, 6, 7, 8, 9, or 10 carbons). Alkyl groups include, but are not limited to, methyl, ethyl, propyl (e.g., n-propyl, isopropyl), butyl (e.g., n-butyl, isobutyl, tert-butyl, sec-butyl), pentyl (e.g., n-pentyl, isopentyl, tert-pentyl, neopentyl, sec-pentyl, 3-pentyl), hexyl, heptyl, octyl, nonyl, and decyl. Alkyl groups may be unsubstituted or substituted by one or more suitable substituents.

The term "cycloalkyl," as used herein, refers to a mono, bicyclic or tricyclic carbocyclic radical (e.g., cyclopropyl, cyclobutyl, cyclopentyl, cyclohexyl, cycloheptyl, cyclooctyl, cyclononyl, cyclopentenyl, cyclohexenyl, bicyclo[2.2.1]heptanyl, bicyclo[3.2.1]octanyl and bicyclo[5.2.0]nonanyl, etc.); optionally containing 1 or 2 double bonds. Cycloalkyl groups may be unsubstituted or substituted by one or more suitable substituents.

In some aspects, the surfactant comprises formula II:

II

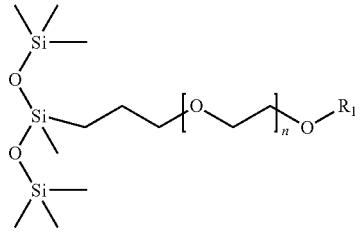

In some aspects, the surfactant comprises formula III:

III

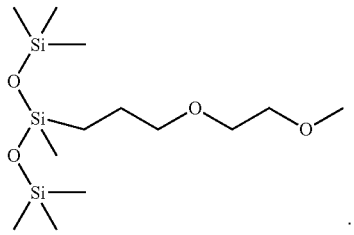

In some aspects, the surfactant may be an alkoxylated ethylenediamine such as, for example, ethylenediamine tetrakis(ethoxylate-block-propoxylate) tetrol.

In some aspects, the alkoxylated ethylenediamine may have a molecular weight of about 3,000 Da to about 5,000 Da.

The compositions disclosed herein may include from about 0.005 wt % to about 0.5 wt % of the surfactant. In some aspects, the composition may include from about 0.0001 wt % to about 1 wt % of the surfactant. In some aspects, the composition may include about 0.01 wt %, about 0.02 wt %, about 0.03 wt %, or about 0.1 wt % of the surfactant.

Suitable strength agents may include but are not limited to natural polymers, such as starch, carboxymethyl cellulose (CMC), xanthan gum and guar gum. Suitable strength agents may include but are not limited to synthetic polymers, such as polyacrylamide (cationic, anionic and amphoteric), glyoxalated polyacrylamides (GPAMs), polyamidoamine epihalohydrin-based polymers and polyvinylamines.

In some aspects, the starch may, for example, be anionic, cationic, non-ionic or amphoteric starch, particularly anionic, non-ionic or amphoteric starch, from various plants, including corn, potato, wheat, tapioca, or sorghum, optionally modified by enzymes, high temperature or chemical/thermal converting techniques, like oxidized starch, ethylated starch or pearl starch. In some aspects, the starch may include: natural starch, modified starch, amylase, amylopectin, styrene-starch, butadiene starch, starches containing various amounts of amylase and amylopectin, such as 25% amylase and 75% amylopectin (corn starch) and 20% amylase and 80% amylopectin (potato starch); enzymatically treated starches; hydrolyzed starches; heated starches, also known in the art as "pasted starches"; cationic starches, such as those resulting from the reaction of a starch with a tertiary amine to form a quaternary ammonium salt; non-ionic starches; anionic starches; amphoteric starches (containing both cationic and anionic functionalities); cellulose and cellulose derived compounds; and any combination thereof and/or a combination thereof which explicitly excludes one or more of these.

In some aspects, the composition may have about 1 wt % to about 20 wt %, about 1 wt % to about 15 wt %, about 1 wt % to about 10 wt %, or about 1 wt % to about 5 wt % of the strength agent. In some aspects, the composition may have about 2 wt %, about 3 wt %, about 4 wt %, about 5 wt %, about 6 wt %, about 7 wt %, about 8 wt %, about 9 wt %, or about 10 wt % of the strength agent. In some aspects, the composition may have about 1 wt % to about 20 wt %, about 1 wt % to about 15 wt %, about 1 wt % to about 10 wt %, or about 1 wt % to about 5 wt % of a non-ionic starch.

Suitable sizing agents include but are not limited to rosin size and water-insoluble hydrophobic cellulose-sizing agents, such as alkyl ketene dimer ("AKD"), alkenyl succinic anhydride (ASA), styrene acrylic acid (SAA) emulsions, styrene acrylate emulsions (SAE), styrene maleic anhydride (SMA) emulsions, ethylene acrylic acid (EAA), polyurethane, and mixtures thereof. For example, the sizing agent may be Perglutin 400.

Suitable colorants may include but are not limited to organic compounds having conjugated double bond systems; azo compounds; metallic azo compounds; anthraquinones; friaryl compounds, such as triarylmethane; quinoline and related compounds; acidic dyes (anionic organic dyes containing sulfonate groups, used with organic rations such as alum); basic dyes (cationic organic dyes containing amine functional groups); and direct dyes (acid-type dyes having high molecular weights and a specific, direct affinity for cellulose); as well as combinations of the above-listed suitable dye compounds.

In some aspects, the colorant may be Cartasol Brown.

The presently disclosed compositions may include various components. Further, the formulation may be aqueous-based, hydrocarbon based, organic solvent based, emulsion based (water-in-oil, oil-in-water), etc.

Other components may include but are not limited to optical brightening agents, biocides, retention aids, defoamers, pH control agents, pitch control agents, and drainage aids.

For example, a component may be a polyaluminum chloride (PAC) compound. Any PAC may be used in accordance with the present disclosure. In some aspects, the PAC is selected from the group consisting of phosphated polyaluminum chloride, sulfated polyaluminum chloride, polyaluminum chloride, polyaluminum silica sulfate chloride, and any combination thereof. In some aspects, the PAC is phosphated polyaluminum chloride.

In other aspects, any composition disclosed herein may be disposed on the surface of a paper press roll. In some aspects, the paper press roll may be a sizing press roll. The composition may be disposed over at least a portion of the surface of the roll. In some aspects, the composition may be sprayed over the entire surface of the sizing press roll. In some aspects, the composition may be sprayed over at least a portion of the surface of the sizing press roll.

A method of treating paper is provided. The method may include applying any composition disclosed herein onto a paper press roll to form a coated paper press roll and contacting paper with the coated paper press roll.

In some aspects, certain components of the composition may be applied separately in separate compositions onto the paper press roll. For example, a composition comprising a strength agent and a surfactant may be sprayed onto the roll separately from a composition comprising a sizing agent and a surfactant.

Properties of the treated paper may be enhanced when a surfactant is included in the paper coating composition. For example, the surfactant may enhance the effects of strength agents in the composition. Without being bound by any particular theory, the surfactant allows the strength agent to penetrate the paper thereby imparting improved bulk strength characteristics.

The treated paper may have a Cobb value equal to or less than a Cobb value of paper treated with the strength agent or sizing agent but not with the surfactant. In some aspects, the treated paper may have a Cobb value equal to or less than a Cobb value of paper treated with the strength agent and the sizing agent but not with the surfactant.

In some aspects, the treated paper may have a Cobb value of about 5 percent to about 40 percent less, about 5 percent to about 30 percent less, about 10 percent to about 30 percent less, or about 10 percent to about 20 percent less than the Cobb value of a paper treated with the strength agent or sizing agent but not with the surfactant.

In some aspects, the treated paper may have increased bulk strength properties, such as short span compression test (SCT) strength, tensile strength, Concora fluted edge crush (CFC) strength, ring crush strength, and burst strength, than paper treated with the strength agent but not with the surfactant. Bulk strength may be measured by any technique known to one of ordinary skill in the art. For example, SCT may be measured as defined in TAPPI Method T826 om-04; tensile strength may be measured as defined in TAPPI Method T494 om-13, CFC may be measured as defined in TAPPI Method T843 om-02; ring crush strength may be measured as defined in TAPPI Method T822 om-02; and burst strength may be measured as defined in TAPPI Method T403 om-02. In other aspects, the treated paper may have a tensile strength value greater than a tensile strength value of paper treated with the strength agent but not with the surfactant.

In some aspects, a bulk strength property may increase by at least about 5 percent, at least about 10 percent, at least about 15 percent, or at least about 20 percent. In some aspects, the SCT strength may increase by at least about 5 percent, at least about 10 percent, at least about 15 percent, or at least about 20 percent. In some aspects, the tensile strength may increase by at least about 5 percent, at least about 10 percent, at least about 15 percent, or at least about 20 percent. In some aspects, the CFC strength may increase by at least about 5 percent, at least about 10 percent, at least about 15 percent, or at least about 20 percent. In some aspects, the ring crush strength may increase by at least about 5 percent, at least about 10 percent, at least about 15 percent, or at least about 20 percent. In some aspects, the burst strength may increase by at least about 5 percent, at least about 10 percent, at least about 15 percent, or at least about 20 percent.

In some aspects, two or more bulk strength properties may increase by at least about 5 percent, at least about 10 percent, at least about 15 percent, or at least about 20 percent. In some aspects, the burst strength and SCT may increase by at least about 5 percent, at least about 10 percent, at least about 15 percent, or at least about 20 percent. In some aspects, the CFC strength and SCT strength may increase by at least about 5 percent, at least about 10 percent, at least about 15 percent, or at least about 20 percent.

In some aspects, the composition may be sprayed onto the paper press roll.

The methods described in the present disclosure can be practiced on conventional papermaking equipment. Although papermaking equipment varies in operation and mechanical design, the methods by which paper is made on different equipment contain common stages. Papermaking typically includes a pulping stage, a bleaching stage, a stock preparation stage, a wet end stage, and a dry end stage.

In the pulping stage, individual cellulose fibers are liberated from a source of cellulose by mechanical and/or chemical action. The pulp is suspended in water in the stock preparation stage. The wet end stage of the papermaking process comprises depositing the stock suspension or pulp slurry on the wire or felt of the papermaking machine to form a continuous web of fibers, draining of the web, and consolidation of the web ("pressing") to form a sheet. In the dry end stage of the papermaking process, the web is dried and may be subjected to additional processing like passing it through a size press, calendering, spray coating with surface modifiers, printing, cutting, corrugating and the like. In addition to using a size press and/or a calender waterbox, the dried paper can be treated by spray coating using a sprayboom.

As used herein "Dry End" means that portion of the papermaking process including and subsequent to a press section where a liquid medium such as water typically comprises less than 45% of the mass of the substrate, dry end includes but is not limited to the size press portion of a papermaking process, additives added in a dry end typically remain in a distinct coating layer outside of the slurry.

The present disclosure contemplates using a paper coating composition in one or more stages of the papermaking process described above.

A typical papermaking machine includes components such as a dryer, a calendering system, and a surface sizing system. The surface sizing system may comprise a size press which applies sizing agents or other compounds, such as optical brightening agents, to the surface of the paper. Generally, a size press applies various solutions or formulations to the surface of paper. The paper may have been dried or partially dried before treatment by the size press.

In some aspects, the paper coating composition may be applied to the paper substrate as a surface treatment. For example, if the substrate is paper, the composition may be applied to one side of the paper or both sides of the paper.

In some aspects, the paper substrate on which the composition is applied is not creped paper.

In general, the paper coating composition may be applied at or near the size press, although the composition can certainly be applied at other locations in the papermaking process. In most instances, the size press is situated downstream of a first drying section. The composition may be applied using conventional size presses, although other components/techniques (e.g. spraying, doctor bar, or other conventionally used coating equipment) may be used to apply the composition.

It should be noted that application of chemicals at, near, or after the size press may be differentiated from application of chemicals at the wet end of the papermaking machine. One difference relates to the fact that the paper is dried, or at least partially dried, before it arrives at the size press.

EXAMPLES

In the laboratory work reported below, measurements of surface tension (Wilhelmy plate technique) and viscosity (Brookfield with a small sample adapter) were performed on coating formulations at 60° C. Contact angle (image analysis techniques) measurements were performed with the formulation close to 60° C. but the substrate was not at this temperature. Next, the sizing response was measured using the Cobb sizing test on sheets coated using the drawdown method with wire-wound rods.

Example 1

The table below shows the effect of three different surfactants on the surface tension of about 5 wt % anionic starch solutions. The surfactants tested are labeled A-K and represent the following compounds, A=Tegopren 5840, B=Silwet L-77, C=Plurafac RA 300, D=Dow Corning 502W, E=Pluronic 31R1, F=Tetronic 701, G=Tetronic 901, H=Airase 5600, I=Airase 5700, J=Dow Corning 57, and K=Dow Corning 501W. Surfactants A, B, D, and K are considered to be superwetters. Surfactants E, F, and G are defoamers. Surfanctants H and I are silicone defoamers. Surfactant J is a silicone glycol copolymer and surfactant C is a low foam wetter.

TABLE 1

Surface tension of starch solutions and surfactants ('ppm' for parts per million).

| | | Composition, wt % | | Surfactant, | Surfactant/ | Surface tension, mN/m | |
|---|---|---|---|---|---|---|---|
| Solution | Surfactant | Starch | Surfactant | ppm | Starch | Average | standard deviation |
| 0 | — | 0 | 0 | 0 | 0 | 66.7 | 0.4 |
| 1 | — | 5.0 | 0.00 | 0 | 0.0000 | 36.8 | 0.4 |

TABLE 1-continued

Surface tension of starch solutions and surfactants ('ppm' for parts per million).

| Solution | Surfactant | Composition, wt % Starch | Surfactant | Surfactant, ppm | Surfactant/ Starch | Surface tension, mN/m Average | standard deviation |
|---|---|---|---|---|---|---|---|
| 2 | A | 5.0 | 0.01 | 100 | 0.0020 | 22.6 | 0.5 |
| 3 | A | 5.0 | 0.02 | 200 | 0.0040 | 21.4 | 0.4 |
| 4 | A | 5.0 | 0.03 | 300 | 0.0060 | 21.4 | 0.5 |
| 5 | A | 5.0 | 0.10 | 1,000 | 0.0200 | 20.9 | 0.8 |
| 1 | — | 5.0 | 0.00 | 0 | 0.0000 | 36.8 | 0.4 |
| 6 | B | 5.0 | 0.01 | 100 | 0.0020 | 20.5 | 0.5 |
| 7 | B | 5.0 | 0.02 | 200 | 0.0040 | 21.9 | 0.4 |
| 8 | B | 5.0 | 0.03 | 300 | 0.0060 | 21.1 | 0.3 |
| 9 | B | 5.0 | 0.10 | 1,000 | 0.0200 | 20.7 | 0.2 |
| 1 | — | 5.0 | 0.00 | 0 | 0.0000 | 36.8 | 0.4 |
| 10 | C | 5.0 | 0.01 | 100 | 0.0020 | 33.8 | 0.5 |
| 11 | C | 5.0 | 0.02 | 200 | 0.0040 | 32.6 | 0.4 |
| 12 | C | 5.0 | 0.03 | 300 | 0.0060 | 35.0 | 0.3 |
| 13 | C | 5.0 | 0.10 | 1,000 | 0.0200 | 36.1 | 0.3 |

Example 2

Study 2 demonstrates the sensitivity of the surface tension of starch solutions to the presence of the surfactant without and with the surface size agent and dye.

TABLE 2

Effect of size agent and dye on surface tension

| Solution | Surfactant | Composition, wt % Starch | Size agent | Dye | Surfactant | Surface tension, mN/m Average | standard deviation |
|---|---|---|---|---|---|---|---|
| 1 | — | 9 | 0.0 | 0.0 | 0.00 | 43.11 | 0.06 |
| 2 | D | 9 | 0.0 | 0.0 | 0.02 | 21.00 | 0.20 |
| 3 | D | 9 | 0.0 | 0.0 | 0.03 | 21.20 | 0.10 |
| 4 | D | 9 | 0.0 | 0.0 | 0.10 | 20.00 | 0.06 |
| 5 | — | 9 | 1.8 | 0.1 | 0.00 | 46.15 | 0.07 |
| 6 | D | 9 | 1.8 | 0.1 | 0.02 | 35.15 | 0.07 |

TABLE 2-continued

Effect of size agent and dye on surface tension

| Solution | Surfactant | Composition, wt % Starch | Size agent | Dye | Surfactant | Surface tension, mN/m Average | standard deviation |
|---|---|---|---|---|---|---|---|
| 7 | D | 9 | 1.8 | 0.1 | 0.03 | 33.96 | 0.06 |
| 8 | D | 9 | 1.8 | 0.1 | 0.10 | 22.45 | 0.06 |

Example 3

The effect of several surfactants on surface tension and sizing response is summarized in Table 3 below. With the surfactant concentrations in solution maintained constant at about 100 ppm, these studies emphasize the different magnitudes with which different surfactants affect the solution surface tension and the treated paper sizing response.

TABLE 3

Effect of surfactant on surface tension and sizing response (Cobb). 'lb/t' stands for pounds of actives per 2,000 pounds of dry paper.

| No. | Surfactant | Starch, lb/t | Size agent, lb/t | Dye, lb/t | Surfactant, lb/t | Cobb, $g/m^2$ | Surface tension, mN/m Average | standard deviation |
|---|---|---|---|---|---|---|---|---|
| 1 | — | 64 | 12.9 | 0.6 | 0.00 | 57 | 47.0 | 0.2 |
| 2 | E | 66 | 13.2 | 0.7 | 0.09 | 59 | 43.7 | 0.2 |
| 3 | F | 64 | 12.7 | 0.6 | 0.09 | 65 | 43.9 | 0.2 |
| 4 | G | 64 | 12.7 | 0.6 | 0.09 | 67 | 34.8 | 0.2 |
| 5 | A | 65 | 13.0 | 0.6 | 0.09 | 58 | 45.7 | 0.1 |
| 6 | H | 65 | 13.0 | 0.6 | 0.09 | 59 | 43.2 | 0.3 |
| 7 | I | 63 | 12.7 | 0.6 | 0.09 | 62 | 40.1 | 0.3 |
| 8 | D | 63 | 12.6 | 0.6 | 0.09 | 59 | 39.0 | 0.3 |
| 9 | — | 87 | 17.4 | 0.9 | 0.00 | 26 | 44.6 | 0.3 |
| 10 | B | 89 | 17.9 | 0.9 | 0.14 | 27 | 37.2 | 0.2 |
| 11 | J | 90 | 17.9 | 0.9 | 0.14 | 28 | 41.4 | 0.3 |
| 12 | K | 79 | 15.8 | 0.8 | 0.13 | 31 | 37.8 | 0.3 |

Table 4 below summarizes the results, where surfactants B and G were dosed in the 0-300 ppm and 0-200 ppm range. In each case, a reduction of about 10 mN/m in surface tension was observed when 200 ppm are dosed.

TABLE 4

Dose curves for surfactants B and G.

| No. | Surfactant | Starch, lb/t | Size agent, lb/t | Dye, lb/t | Surfactant, lb/t | Surf. Concen., ppm | Cobb, g/m$^2$ | Surface tension, mN/m Average | Surface tension, mN/m standard deviation |
|---|---|---|---|---|---|---|---|---|---|
| 1 | — | 64 | 12.8 | 0.6 | 0.00 | 0 | 45 | 44.8 | 0.3 |
| 2 | B | 62 | 12.5 | 0.6 | 0.05 | 50 | 44 | 41.0 | 0.3 |
| 3 | B | 64 | 12.8 | 0.6 | 0.10 | 100 | 46 | 37.0 | 0.6 |
| 4 | B | 69 | 13.9 | 0.7 | 0.17 | 150 | 41 | 35.1 | 0.2 |
| 5 | B | 64 | 12.9 | 0.6 | 0.21 | 200 | 44 | 34.3 | 0.5 |
| 6 | B | 67 | 13.3 | 0.7 | 0.32 | 300 | 52 | 29.0 | 0.4 |
| 7 | G | 65 | 13.0 | 0.6 | 0.03 | 25 | 44 | 43.3 | 0.3 |
| 8 | G | 63 | 12.6 | 0.6 | 0.05 | 50 | 50 | 42.2 | 0.3 |
| 9 | G | 67 | 13.4 | 0.7 | 0.08 | 75 | 35 | 42.3 | 0.3 |
| 10 | G | 64 | 12.8 | 0.6 | 0.10 | 100 | 38 | 41.8 | 0.2 |
| 11 | G | 63 | 12.6 | 0.6 | 0.20 | 200 | 56 | 34.4 | 0.4 |

Example 5

In size press applications, solution viscosity is an important parameter: high viscosities limit solution transfer to the paper, thereby negatively affecting the overall production rate. Table 5 below shows that the effect of up to 100 pm surfactant in coating solutions has a negligible effect on viscosity.

TABLE 5

Effect of surfactant on solution viscosity.

| No. | Surfactant | Composition, % Starch | Size agent | Dye | Surfactant | Brookfield Viscosity, cP |
|---|---|---|---|---|---|---|
| 1 | — | 6 | 1.2 | 0.06 | 0.00 | 8.75 |
| 2 | — | 9 | 1.8 | 0.09 | 0.00 | 10.7 |
| 3 | — | 12 | 2.4 | 0.12 | 0.00 | 14.2 |
| 4 | B | 6 | 1.2 | 0.06 | 0.01 | 8.25 |
| 5 | B | 9 | 1.8 | 0.09 | 0.01 | 9.75 |
| 8 | B | 12 | 2.4 | 0.12 | 0.01 | 14.5 |
| 7 | G | 6 | 1.2 | 0.06 | 0.01 | 7.5 |
| 8 | G | 9 | 1.8 | 0.09 | 0.01 | 9.25 |
| 9 | G | 12 | 2.4 | 0.12 | 0.01 | 15.7 |

The table below summarizes the contact angle results of solutions containing up to 300 ppm of surfactants B and G.

TABLE 6

Effect of surfactant on drop contact angle with roll surface.

| No. | Composition, % Starch | Size agent | Dye | Surfactant | ppm | Contact Angle, ° 0 s | 30 s |
|---|---|---|---|---|---|---|---|
| 1 | 9.0 | 1.8 | 0.09 | — | 0 | 143 | 139 |
| 2 | 9.0 | 1.8 | 0.09 | B | 100 | 102 | 92 |
| 3 | 9.0 | 1.8 | 0.09 | B | 200 | 101 | 90 |
| 4 | 9.0 | 1.8 | 0.09 | B | 300 | 113 | 98 |
| 5 | 9.0 | 1.8 | 0.09 | — | 0 | 147 | 141 |
| 6 | 9.0 | 1.8 | 0.09 | G | 100 | 116 | 103 |
| 7 | 9.0 | 1.8 | 0.09 | G | 200 | 117 | 106 |
| 8 | 9.0 | 1.8 | 0.09 | G | 300 | 120 | 112 |

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a surfactant" is intended to include "at least one surfactant" or "one or more surfactants."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges (including all fractional and whole values) subsumed therein.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of treating paper, comprising:

applying a composition onto a paper press roll to form a coated paper press roll, the composition comprising a strength agent, a sizing agent, and a surfactant; and contacting paper with the coated paper press roll to form a treated paper, wherein the treated paper has a Cobb value equal to or less than a Cobb value of paper treated with the strength agent and the sizing agent but not with the surfactant;

wherein the strength agent is about 1 wt % to about 10 wt % of the composition;

wherein the surfactant is about 0.005 wt % to about 0.5 wt % of the composition; and wherein the surfactant is an alkoxylated ethylenediamine, or wherein the surfactant comprises formula I:

I

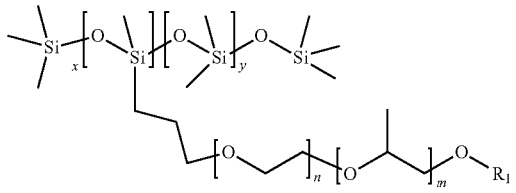

wherein n is an integer ranging from 0 to 100;

m is an integer ranging from 0 to 100;

x is an integer ranging from 1 to 3;

y is an integer ranging from 0 to 5; and $R_1$ is hydrogen, halogen, $C_{1-10}$ alkyl, phenyl, or cycloalkyl.

2. The method of claim 1, wherein the composition is sprayed onto the paper press roll.

3. The method of claim 1, wherein the surfactant is

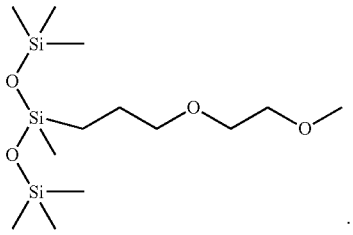

4. The method of claim 1, wherein the treated paper has a Cobb value at least about 10 percent less than the Cobb value of a paper treated with the strength agent and the sizing agent but not with the surfactant.

5. The method of claim 1, wherein the composition is an aqueous solution.

6. The method of claim 1, wherein the surfactant is about 0.01 wt % to about 0.03 wt % of the composition.

7. A method of treating paper, comprising:

applying a composition onto a paper press roll to form a coated paper press roll, the composition comprising a strength agent and a surfactant; and contacting paper with the coated paper press roll to form a treated paper, wherein the treated paper has a tensile strength value greater than a tensile strength value of paper treated with the strength agent but not with the surfactant;

wherein the strength agent is about 1 wt % to about 10 wt % of the composition;

wherein the surfactant is about 0.005 wt % to about 0.5 wt % of the composition; and wherein the surfactant is an alkoxylated ethylenediamine, or wherein the surfactant comprises formula I:

I

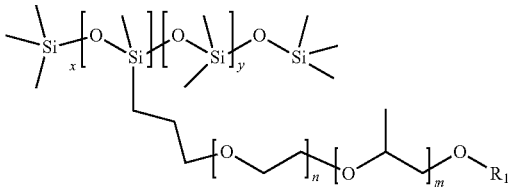

wherein n is an integer ranging from 0 to 100;

m is an integer ranging from 0 to 100;

x is an integer ranging from 1 to 3;

y is an integer ranging from 0 to 5; and $R_1$ is hydrogen, halogen, $C_{1-10}$ alkyl, phenyl, or cycloalkyl.

* * * * *